US011434931B2

(12) United States Patent
Martin et al.

(10) Patent No.: US 11,434,931 B2
(45) Date of Patent: Sep. 6, 2022

(54) FUEL SYSTEM HAVING A VALVE UPSTREAM OF A JET PUMP

(71) Applicant: DELPHI TECHNOLOGIES IP LIMITED, St. Michael (BB)

(72) Inventors: Thomas R. Martin, Cd. Juarez (MX); Abel Melgar, Chihuahua (MX)

(73) Assignee: DELPHI TECHNOLOGIES IP LIMITED, St. Michael (BB)

( * ) Notice: Subject to any disclaimer, the term of this patent is extended or adjusted under 35 U.S.C. 154(b) by 156 days.

(21) Appl. No.: 17/029,632

(22) Filed: Sep. 23, 2020

(65) Prior Publication Data

US 2022/0090610 A1 Mar. 24, 2022

(51) Int. Cl.

| | |
|---|---|
| ***F04F 5/48*** | (2006.01) |
| ***F04F 5/10*** | (2006.01) |
| ***F04F 5/44*** | (2006.01) |
| ***F02M 37/10*** | (2006.01) |
| ***F04B 23/02*** | (2006.01) |
| ***F04B 23/08*** | (2006.01) |

(52) U.S. Cl.

CPC ..... *F04F 5/48* (2013.01); *F02M 37/106* (2013.01); *F04B 23/021* (2013.01); *F04B 23/08* (2013.01); *F04F 5/10* (2013.01); *F04F 5/44* (2013.01)

(58) Field of Classification Search

CPC ..... F04F 5/10; F04F 5/44; F04F 5/48; F04B 23/021; F04B 23/08; F02M 37/106

USPC ..... 417/87, 89

See application file for complete search history.

(56) References Cited

U.S. PATENT DOCUMENTS

| | | | | |
|---|---|---|---|---|
| 4,762,308 | A * | 8/1988 | Geno | B60G 15/14 137/849 |
| 4,926,829 | A * | 5/1990 | Tuckey | F02M 69/465 123/41.31 |
| 5,749,345 | A | 5/1998 | Treml | |
| 6,269,800 | B1 | 8/2001 | Fischerkeller et al. | |
| 6,955,158 | B2 * | 10/2005 | Rumpf | F02M 37/0094 137/574 |
| 7,278,404 | B2 * | 10/2007 | Wolters | F02M 37/106 123/456 |
| 7,469,683 | B2 * | 12/2008 | Mason | F02M 37/025 123/514 |
| 8,590,563 | B2 * | 11/2013 | Martin | F02M 37/106 123/514 |
| 10,094,305 | B1 | 10/2018 | Klein et al. | |
| 2003/0000503 | A1 | 1/2003 | Takahashi | |

(Continued)

FOREIGN PATENT DOCUMENTS

DE 10112361 A1 10/2002

*Primary Examiner* — Charles G Freay

(74) *Attorney, Agent, or Firm* — Joshua M. Haines

(57) ABSTRACT

A fuel system includes a fuel reservoir configured to be located within the fuel tank such that the fuel reservoir defines a fuel reservoir volume which is a subset of a fuel tank volume; a fuel pump configured to pump fuel from within the fuel reservoir volume to the fuel consuming device through a fuel supply line; a jet pump configured to 1) receive excess fuel, through a fuel return line, which had been supplied to the fuel consuming device through the fuel supply line and 2) aspirate fuel into the fuel reservoir volume from the fuel tank volume; and a valve which allows fuel flow in both directions between the fuel return line and the jet pump when a differential pressure across the valve is greater than or equal to a predetermined threshold.

6 Claims, 2 Drawing Sheets

(56) References Cited

U.S. PATENT DOCUMENTS

| | | | | |
|---|---|---|---|---|
| 2008/0149074 | A1* | 6/2008 | Voelker | F02M 55/00 123/511 |
| 2011/0132328 | A1 | 6/2011 | Attwood et al. | |
| 2014/0314591 | A1 | 10/2014 | Herrera et al. | |

* cited by examiner

FUEL SYSTEM HAVING A VALVE UPSTREAM OF A JET PUMP

TECHNICAL FIELD OF INVENTION

The present invention relates to a fuel system, more particularly to a fuel system which includes a jet pump supplied with return fuel from a fuel consuming device, and still even more particularly to such a fuel system which includes a valve upstream of the jet pump.

BACKGROUND OF INVENTION

Fuel systems for internal combustion engines typically include a fuel tank for storing a volume of fuel that will be supplied to the internal combustion engine by a fuel pump. When such fuel systems are provided for a motor vehicle, the fuel system also commonly includes a fuel reservoir positioned within the fuel tank. The fuel reservoir provides a volume of fuel which is filled by fuel from the fuel tank. The fuel pump is positioned within the fuel reservoir in order to ensure an adequate supply of fuel is available to the fuel pump when the fuel tank is not full and dynamics of the motor vehicle may cause the fuel within the fuel tank to slosh or migrate to an area of the fuel tank away from the fuel reservoir. In order to maintain a sufficient level of fuel within the fuel reservoir, a jet pump, powered by excess fuel returned to the fuel tank from the internal combustion engine in some examples, is used to aspirate fuel from the fuel tank into the fuel reservoir.

In order to prevent fuel from leaking out of the fuel tank in the event that the fuel return line is broken outside of the fuel tank, particularly when the fuel tank becomes tipped or inverted, for example, when a vehicle containing the fuel tank is involved in an accident, some fuel systems include a unidirectional check valve which allows fuel to flow into the fuel tank, but prevents fuel from flowing out of the fuel tank. However, known unidirectional check valves require multiple components which adds to overall cost, and furthermore, some unidirectional check valves can undesirably restrict the return fuel flow, thereby reducing efficiency of the jet pump.

What is needed is a fuel supply system which minimizes or eliminates one or more of the shortcomings as set forth above.

SUMMARY OF THE INVENTION

Briefly described, a fuel system is provided for supplying fuel from a fuel tank defining a fuel tank volume to a fuel consuming device. The fuel system includes a fuel reservoir configured to be located within the fuel tank such that the fuel reservoir defines a fuel reservoir volume which is a subset of the fuel tank volume; a fuel pump configured to pump fuel from within the fuel reservoir volume to the fuel consuming device through a fuel supply line; a jet pump configured to 1) receive excess fuel, through a fuel return line, which had been supplied to the fuel consuming device through the fuel supply line and 2) aspirate fuel into the fuel reservoir volume from the fuel tank volume; and a valve which allows fuel flow from the fuel return line to the jet pump when a differential pressure across the valve is greater than or equal to a predetermined threshold and which also allows fuel flow from the jet pump to the fuel return line when the differential pressure across the valve is greater than or equal to the predetermined threshold. The fuel system disclosed herein allows for minimized cost while preventing fuel leakage out of the fuel tank when the fuel return line becomes damaged and also while keeping fuel return line primed when the fuel pump is not operating.

BRIEF DESCRIPTION OF DRAWINGS

This invention will be further described with reference to the accompanying drawings in which.

DETAILED DESCRIPTION OF INVENTION

Figure 1:
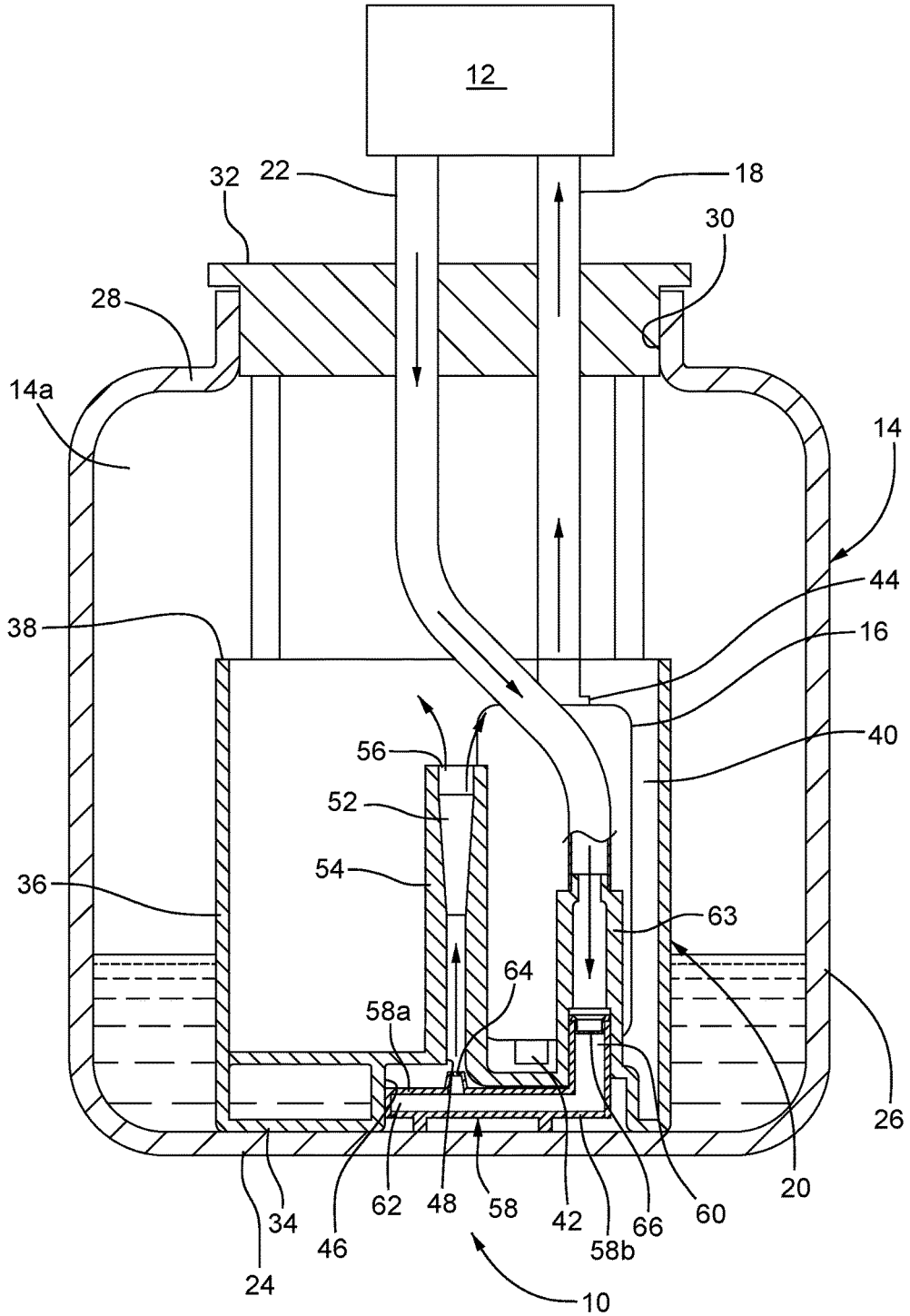
FIG. 1 is a schematic cross-sectional view of a fuel system in accordance with the present disclosure.
Figure 2:
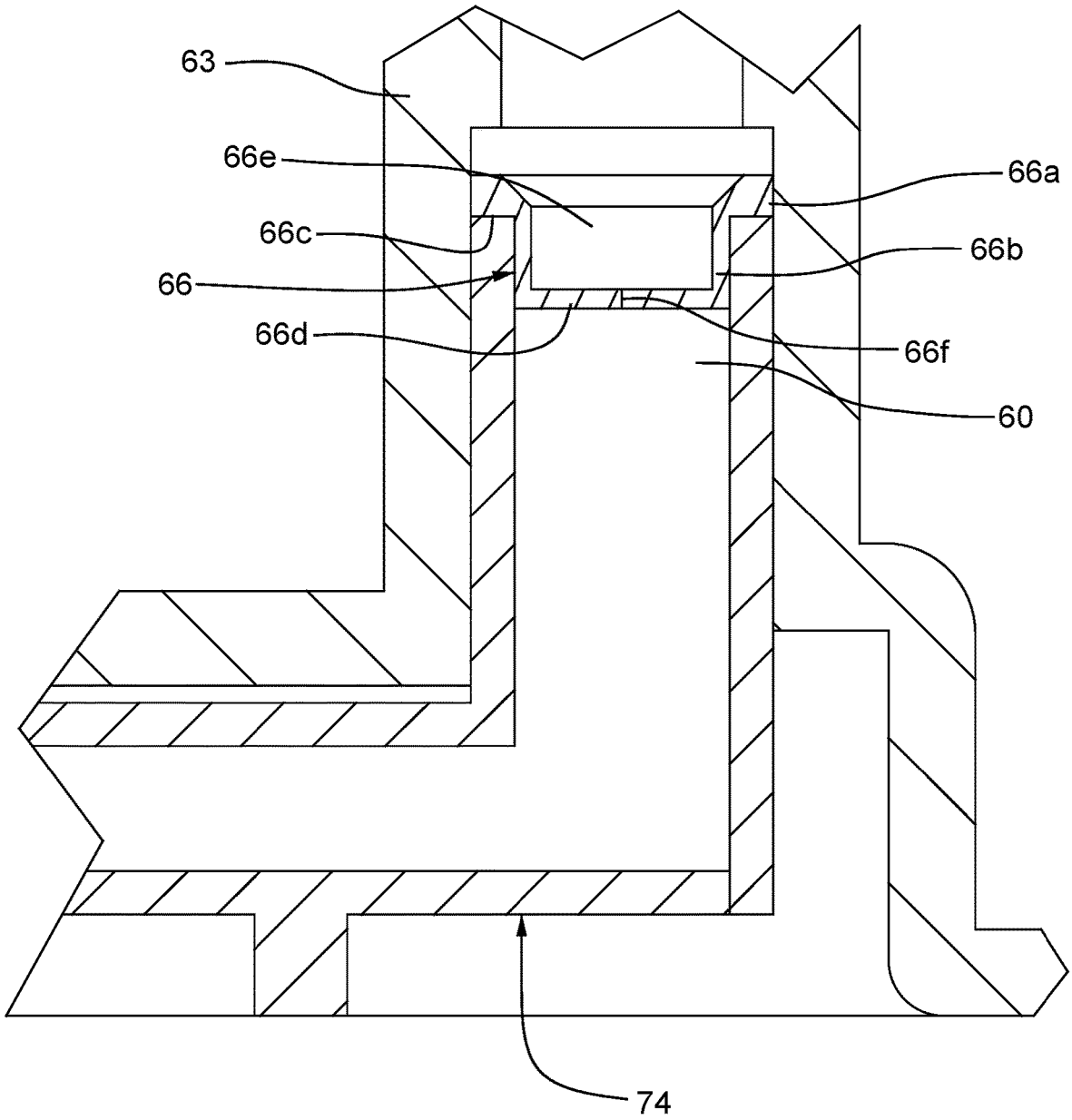
FIG. 2 is an enlarged portion of FIG. 1.

Referring to the drawings, a fuel system 10 is shown in accordance with the present disclosure for supplying fuel to a fuel consuming device, illustrated by way of non-limiting example only, as an internal combustion engine 12. The fuel of fuel system 10 may be any liquid fuel customarily used, for example only, gasoline, diesel fuel, alcohol, ethanol, and the like, and blends thereof.

Fuel system 10 includes a fuel tank 14 for storing a quantity of fuel and a fuel pump 16 for pumping fuel from fuel tank 14 to internal combustion engine 12. Fuel that is pumped by fuel pump 16 is communicated to internal combustion engine 12 through a fuel supply line 18. Fuel pump 16 is an electric fuel pump which receives electricity from an electricity source (not shown), and may be, by way of non-limiting example only, a fuel pump as disclosed in United States Patent Application Publication No. US 2014/0314591 A1, the entire disclosure of which is incorporated herein by reference in its entirety. Fuel pump 16 is disposed within a fuel reservoir 20 which is a separate container within fuel tank 14 and which is filled with fuel. A fuel return line 22 is provided from internal combustion engine 12 to fuel tank 14 in order to return fuel to fuel tank 14 that has been supplied to internal combustion engine 12 by fuel pump 16 which is in excess of that needed to support operational demands of internal combustion engine 12. As used herein, fuel in considered to have been supplied to internal combustion engine 12 when the fuel has exited fuel tank 14 through fuel supply line 18. Fuel reservoir 20 is filled by fuel simply spilling over the top of fuel reservoir 20 when the fuel level in fuel tank 14 is sufficiently high. Fuel reservoir 20 is also filled by fuel return line 22 as will be described in greater detail later.

Fuel tank 14 will now be described in greater detail. Fuel tank 14 has a fuel tank bottom wall 24, a fuel tank sidewall 26 around the periphery of fuel tank bottom wall 24 which extends generally perpendicular upward from fuel tank bottom wall 24, and a fuel tank top wall 28 which extends from fuel tank sidewall 26 in a generally perpendicular direction such that fuel tank top wall 28 opposes fuel tank bottom wall 24. Together, fuel tank bottom wall 24, fuel tank sidewall 26, and fuel tank top wall 28 define a fuel tank volume 14*a* for containing the fuel. Fuel tank top wall 28 includes a fuel tank opening 30 therethrough which accommodates insertion of fuel pump 16 and fuel reservoir 20 thereinto such that fuel tank opening 30 is closed by a fuel tank cover 32. Fuel tank 14 is made of a rigid material as is well known to those of skill in the art of fuel tanks, and may be, by way of non-limiting example only, a plastic material manufactured by a blow molding process or a metal material such as steel.

Fuel reservoir 20, which is located within fuel tank 14, will now be described in greater detail. Fuel reservoir 20 includes a fuel reservoir bottom wall 34 and a fuel reservoir sidewall 36 which is generally annular in shape such that fuel reservoir sidewall 36 extends from fuel reservoir bottom wall 34 in a generally perpendicular direction from fuel reservoir bottom wall 34 to a top end 38 thereof which is open and which defines an overflow level of fuel reservoir 20. In this way, fuel reservoir 20 is bucket-shaped and defines a fuel reservoir volume 40 therewithin such that fuel pump 16 is disposed within fuel reservoir volume 40 which is a subset of fuel tank volume 14*a*. Fuel is drawn into fuel pump 16 through a fuel pump inlet 42 of fuel pump 16 from fuel reservoir volume 40 and pumps the fuel to fuel supply line 18 through a fuel pump outlet 44 of fuel pump 16. Fuel reservoir bottom wall 34 includes a fuel reservoir recess 46 which faces toward fuel tank bottom wall 24 such that a refill opening 48 passes through fuel reservoir bottom wall 34 into fuel reservoir recess 46.

A fuel reservoir refill passage 52 defined by a fuel reservoir refill tube 54 is located within fuel reservoir volume 40 such that refill opening 48 opens into fuel reservoir refill passage 52. As shown, fuel reservoir refill tube 54 may be molded as a single piece of plastic with fuel reservoir 20, but may alternatively be formed separately and subsequently fixed to fuel reservoir 20. Fuel reservoir refill passage 52 is open to fuel reservoir recess 46 through refill opening 48, and in this way, refill opening 48 serves as an inlet to fuel reservoir refill passage 52. Fuel reservoir refill passage 52 includes a fuel reservoir refill passage outlet 56 which opens into fuel reservoir volume 40. Fuel reservoir refill passage 52 is used to refill fuel reservoir volume 40 as will be described in greater detail later.

In order to refill fuel reservoir volume 40 with fuel, a jet pump 58 is provided which is a tube defining a jet pump fuel passage 62. As shown, jet pump 58 may comprise a jet pump upper portion 58*a* and a jet pump lower portion 58*b* which are sealingly joined together to define jet pump fuel passage 62, where the two-piece nature allows for manufacturing jet pump 58 using conventional injection molding processes. Jet pump 58 includes a jet pump inlet 60 which is in selective fluid communication with fuel return line 22 such that jet pump fuel passage 62 receives fuel from fuel return line 22 through a jet pump supply tube 63 of fuel reservoir 20 which extends through fuel reservoir bottom wall 34. Jet pump 58, together with fuel reservoir refill passage 52 define a jet pump assembly. While jet pump 58 has been illustrated herein as being formed as a separate component from fuel reservoir refill passage 52, it should now be understood that jet pump 58 may alternatively be integrally formed as a single piece with one or more of fuel reservoir refill passage 52 such that jet pump 58 is still identifiable as a tube distinct from the tubes which form fuel reservoir refill passage 52.

Jet pump 58 includes a jet pump exit orifice 64 which extends therethrough, i.e. through the wall of jet pump 58, to define an outlet of jet pump fuel passage 62. Jet pump exit orifice 64 is directed into fuel reservoir refill passage 52, and consequently, fuel that exits jet pump 58 through jet pump exit orifice 64 creates a venturi effect within fuel reservoir refill passage 52 which draws fuel into fuel reservoir refill passage 52 from fuel tank volume 14*a*/fuel reservoir recess 46 through refill opening 48. The fuel drawn into fuel reservoir refill passage 52 through refill opening 48 combines with the fuel directed into fuel reservoir refill passage 52 from jet pump exit orifice 64 and exits fuel reservoir refill passage 52 through fuel reservoir refill passage outlet 56 to refill fuel reservoir volume 40. In this way, excess fuel that is returned from internal combustion engine 12 and fuel within fuel tank volume 14*a* that is outside of fuel reservoir volume 40 fills fuel reservoir volume 40.

A valve 66 is provided in fuel reservoir refill passage 52 upstream of jet pump 58 such that valve 66 allows fuel flow in both directions between fuel return line 22 and jet pump 58, i.e. from fuel return line 22 to jet pump 58 and from jet pump 58 to fuel return line 22 when a differential pressure across valve 66 is greater than or equal to a predetermined threshold. While valve 66 is capable of allowing flow in both directions, it should be understood that conventional operation of fuel system 10 will provide flow of fuel in a direction from fuel return line 22 to jet pump 58. Valve 66 prevents fuel from leaking out of fuel tank 14 in the event that fuel return line 22 is broken outside of fuel tank 14, particularly when the fuel system 10 becomes tipped or inverted, for example, when a vehicle containing fuel system 10 is involved in an accident. In one example, the predetermined threshold is the pressure produced by a 15-centimeter (cm) column of E85 based on ASTM International D5798, however, the predetermined threshold may be tailored to the needs of fuel system 10 based on the size of fuel tank volume 14*a* in order to prevent fuel from flowing out of fuel tank 14 through fuel return line 22. That is, the predetermined threshold would be selected to be greater than the pressure resulting from depth of fuel in fuel tank 14 as wells as selected to take into account the intended fuel to be used.

Valve 66 is an elastomer material which is resilient and compliant and is unitary, i.e. single piece, in construction. Valve 66 includes an upper portion 66*a* which is annular in shape and which is larger in diameter than a lower portion 66*b* which is also annular in shape, thereby forming a shoulder 66*c* which abuts jet pump inlet 60 to position valve 66. The outer periphery of upper portion 66*a* circumferentially engages the inner periphery of jet pump supply tube 63 in an interference fit and the outer periphery of lower portion 66*b* circumferentially engages the inner periphery of jet pump inlet 60 in an interference fit, thereby preventing fuel from bypassing around valve 66. The end of lower portion 66*b* which is distal from upper portion 66*a* includes an end wall 66*d* which closes a central passage 66*e* of valve 66 when valve 66 is subjected to a differential pressure that is less than the predetermined threshold. However, end wall 66*d* includes a slit 66*f* extending therethrough which allows end wall 66*d* to elastically deform when valve 66 is subjected to a differential pressure that is greater than or equal to the predetermined threshold, thereby providing fluid communication between fuel return line 22 and jet pump inlet 60. When the differential pressure applied to valve 66 is subsequently reduced to again be less than the predetermined threshold, end wall 66*d* springs back to its predeformed shape, thereby preventing fluid communication between fuel return line 22 and jet pump inlet 60. As a result, valve 66 not only prevents fuel from leaking under the aforementioned conditions, but also keeps fuel return line 22 primed when fuel pump 16 is not running, thereby allowing jet pump 58 to begin operation immediately following start of operation of fuel pump 16. Valves such as valve 66 are known to those of skill in the art, however, are used in context of preventing siphoning of fuel out of the fuel reservoir when the jet pump is powered directly by the fuel pump without being supplied to the internal combustion engine. In such known uses, the fuel pump has a dedicated output for powering the jet pump and therefore, the fuel reservoir could be emptied through siphoning when the fuel pump is not operating and in the absence of an anti-siphoning valve.

Fuel system 10 as disclosed herein allows for minimized cost while preventing fuel leakage out of fuel tank 14 when fuel return line 22 becomes damaged and also while keeping fuel return line 22 primed when fuel pump 16 is not operating.

While this invention has been described in terms of preferred embodiments thereof, it is not intended to be so limited, but rather only to the extent set forth in the claims that follow.

We claim:

1. A fuel system for supplying fuel from a fuel tank defining a fuel tank volume to a fuel consuming device, said fuel system comprising:

a fuel reservoir configured to be located within said fuel tank such that said fuel reservoir defines a fuel reservoir volume which is a subset of said fuel tank volume;

a fuel pump configured to pump fuel from within said fuel reservoir volume to said fuel consuming device through a fuel supply line;

a jet pump configured to 1) receive excess fuel, through a fuel return line, which had been supplied to said fuel consuming device through said fuel supply line and 2) aspirate fuel into said fuel reservoir volume from said fuel tank volume; and a valve which allows fuel flow from said fuel return line to said jet pump when a differential pressure across said valve is greater than or equal to a predetermined threshold and which also allows fuel flow from said jet pump to said fuel return line when said differential pressure across said valve is greater than or equal to said predetermined threshold.

2. A fuel system as in claim 1, wherein said predetermined threshold is a 15 cm column of E85.

3. A fuel system as in claim 1, wherein said valve includes an annular wall with a central passage therein and an end wall with a slit extending therethrough such that 1) said end wall closes said central passage when said differential pressure across said valve is less than said predetermined threshold, thereby preventing fluid communication between said fuel return line and said jet pump and 2) said end wall elastically deforms when said differential pressure across said valve is greater than or equal to said predetermined threshold, thereby opening said central passage and allowing fluid communication from said fuel return line to said jet pump.

4. A fuel system for supplying fuel to a fuel consuming device, said fuel system comprising:

a fuel tank which defines a fuel tank volume which is configured to hold fuel;

a fuel reservoir located within said fuel tank such that said fuel reservoir defines a fuel reservoir volume which is a subset of said fuel tank volume;

a fuel pump configured to pump fuel from within said fuel reservoir volume to said fuel consuming device through a fuel supply line;

a jet pump configured to 1) receive excess fuel, through a fuel return line, which had been supplied to said fuel consuming device through said fuel supply line and 2) aspirate fuel into said fuel reservoir volume from said fuel tank volume; and a valve which allows fuel flow from said fuel return line to said jet pump when a differential pressure across said valve is greater than or equal to a predetermined threshold and which also allows fuel flow from said jet pump to said fuel return line when said differential pressure across said valve is greater than or equal to said predetermined threshold.

5. A fuel system as in claim 4, wherein said predetermined threshold is a 15 cm column of E85.

6. A fuel system as in claim 4, wherein said valve includes an annular wall with a central passage therein and an end wall with a slit extending therethrough such that 1) said end wall closes said central passage when said differential pressure across said valve is less than said predetermined threshold, thereby preventing fluid communication between said fuel return line and said jet pump and 2) said end wall elastically deforms when said differential pressure across said valve is greater than or equal to said predetermined threshold, thereby opening said central passage and allowing fluid communication from said fuel return line to said jet pump.

* * * * *